US005121832A

United States Patent [19]

Fiocchi

[11] Patent Number: 5,121,832

[45] Date of Patent: Jun. 16, 1992

[54] ALVEOLATE CONTAINER FOR EXPLOSIVE PRIMERS

[75] Inventor: Paolo Fiocchi, Lecco, Italy

[73] Assignee: Fiocchi Munizioni S.p.A., Lecco, Italy

[21] Appl. No.: 652,642

[22] Filed: Feb. 8, 1991

[30] Foreign Application Priority Data

Feb. 9, 1990 [IT] Italy ..... 20602/90[U]

[51] Int. Cl.[5] ..... F42B 39/00; B65D 1/34; B65D 81/02; B65D 85/30

[52] U.S. Cl. ..... 206/3; 206/558; 206/564; 206/561; 206/521; 89/34

[58] Field of Search ..... 206/3, 558, 564, 561, 206/521; 89/34

[56] References Cited

U.S. PATENT DOCUMENTS

| | | | |
|---|---|---|---|
| 2,795,323 | 6/1957 | Amundsen | 206/3 |
| 3,756,387 | 9/1973 | Chaney | 206/3 |
| 4,199,057 | 4/1980 | Gruaz | 206/3 |
| 4,930,626 | 6/1990 | Miller | 206/3 |

FOREIGN PATENT DOCUMENTS

| | | | |
|---|---|---|---|
| 1049682 | 11/1966 | United Kingdom | 206/3 |

*Primary Examiner*—Paul T. Sewell
*Assistant Examiner*—M. D. Patterson
*Attorney, Agent, or Firm*—Finnegan, Henderson, Farabow, Garrett & Dunner

[57] ABSTRACT

Alveolate container for the packaging of explosive primers includes a bottom half having a plurality of alveoli arranged in parallel rows. Each alveolus is configured for housing an explosive primer for firearm cartridges with the percussion surface of the primer positioned near the mouth of the alveolus and a space defined between the concave bottom and an end of the primer opposite the percussion surface. The container also includes a cover half hingedly-connected to the bottom half and configured for hingedly closing upon the bottom half for substantially isolating the mouths of the alveoli from the outside of the container. The cover half includes a rib corresponding with the center line of each row of alveoli to constitute, upon closing, a limit to the movement of the primers from the mouths of the alveoli. Preferably the container is formed from a single piece of plastic material.

9 Claims, 2 Drawing Sheets

20
22
20
IV
IV
11
18
14
10
14
III
III
12
19
19

21
20
11
21
10
17
13
19
12

ALVEOLATE CONTAINER FOR EXPLOSIVE PRIMERS

BACKGROUND OF THE INVENTION

1. Field of the Invention

The present invention relates to an improved alveolate container for the packaging of explosive primers usually employed to provide firearm cartridges.

2. Description of the Prior Art

One problem in providing multiple packages for primers, in addition to assuring correct preservation of the product, is the need to minimize the risk of exposing one or more primers contained within the package to any flame, excessive heat, accidental shocks which may cause an inadvertent explosion. In addition, another problem even greater than that above is the need to eliminate the possibility of a chain reaction caused by the explosion of a few, or even just one, of the primers in the package, which may create a dangerous mass explosion. For example, even if an explosion of a few primers within the container takes place due to shock, such an exposion produces a violent development of pressure and flame which propagates throughout the package and causes a chain effect of explosions of the other primers contained therein. Such a chain effect progresses so rapidly that it is substantially equivalent to an almost simultaneous explosion of all the primers in the package. The obvious risk is even greater in the case of several containers of primers generally packaged in large numbers for handling and storage with the danger of explosion extending to the several packages simultaneously. Solutions of the known art to the above problems generally employ containers of relatively stout material, which makes their manufacture costly and, due to their volume, causes less than optimal utilization of storage space. The general object of the present invention is to obviate the above mentioned drawbacks by providing an improved alveolate package for primers which would minimize the probability of explosion due to shock or excessive heat and would prevent mass explosion of the primers while being simple to produce and using a minimal quantity of material.

SUMMARY OF THE INVENTION

In view of said object it has been sought to provide in accordance with the invention a container comprising two hinged halves, for closing, which constitute the bottom half and cover half, respectively. The bottom half comprises a plurality of alveoli arranged in parallel rows, with each alveolus adapted for housing an explosive primer for firearm cartridges or the like. Each alveolus is such that the percussion surface of a respective primer is positioned near the mouth of the alveolus. The cover half, upon closing, is adapted substantially isolate the alveoli from the outside of the container, and is characterized in that the cover half is moulded and formed from a plastic sheet. Each alveolus has a virtually concave bottom to constitute an empty space between the concave bottom and the end of the primer opposite the percussion surface. The cover half includes a rib corresponding with the center line of each row of alveoli to constitute, upon closing, a limit to the movement of the primers toward the outside of the alveoli. To further clarify the explanation of the innovative principles of the present invention and its advantages as compared with the known art there is described below, with the aid of the annexed drawings, possible embodiments as examples applying the principles.

DESCRIPTION OF THE PREFERRED EMBODIMENT

Figure 1:
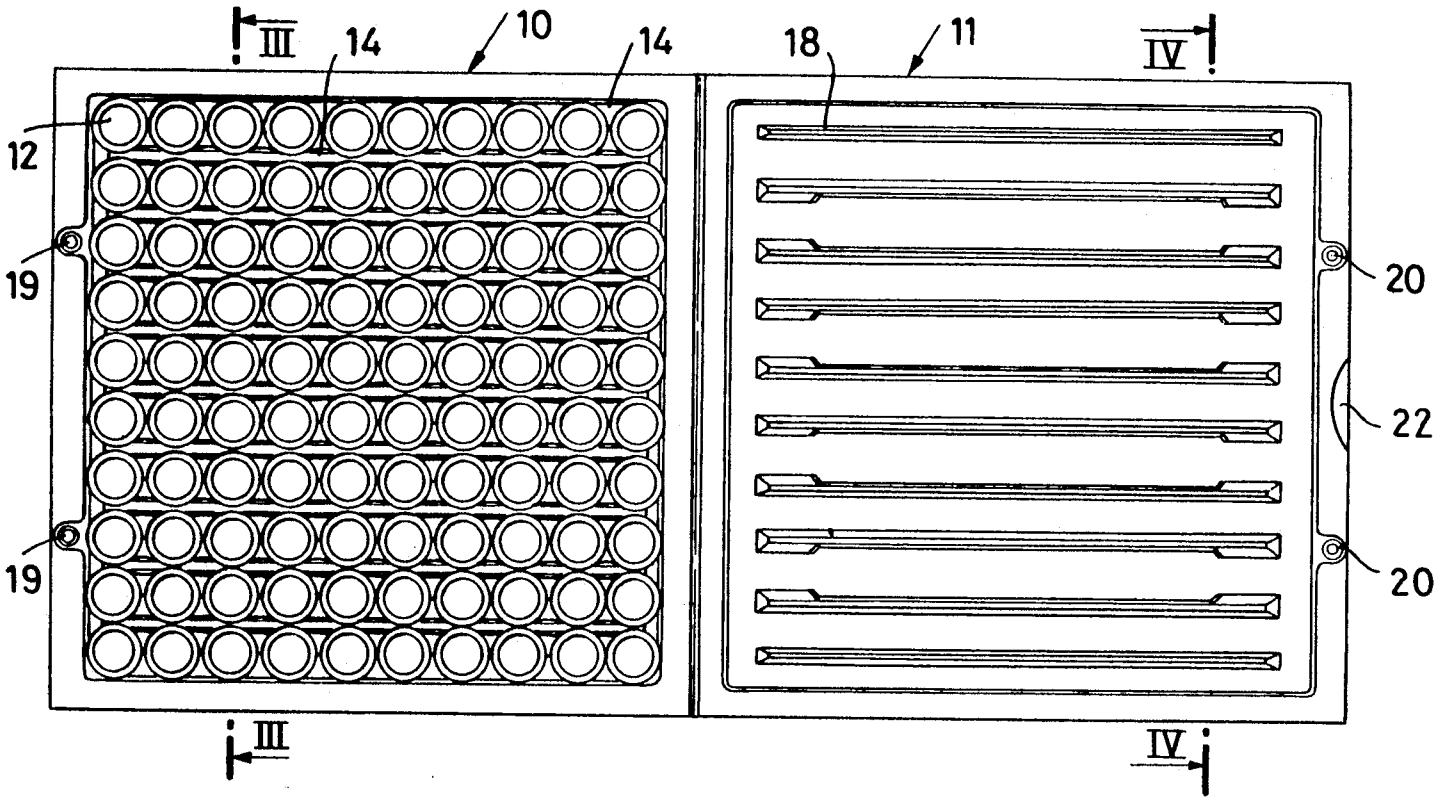
FIG. 1 shows a top view of a package in accordance with the invention in the open position.

With reference to the figures, and as shown in FIG. 1, a container in accordance with the invention comprises two hinged halves made up of a first bottom half 10 and a second cover half 11. Preferably, the container is moulded from a single plastic sheet, e.g. heat formed PVC.

Figure 2:
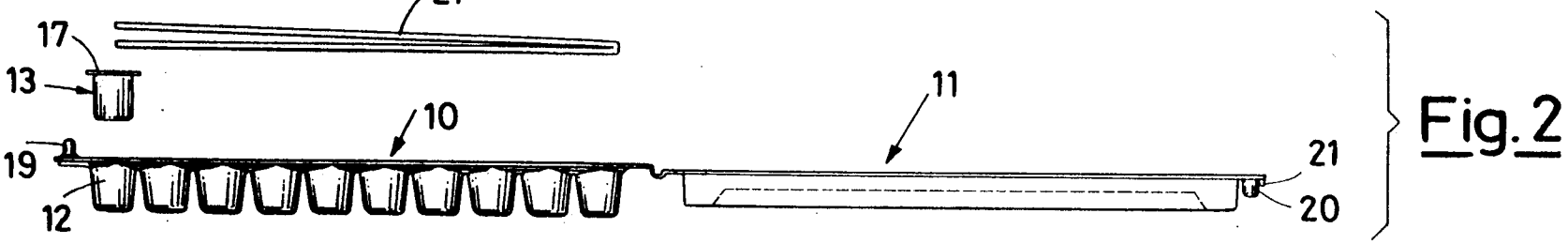
FIG. 2 shows a side elevation of the container of FIG. 1 with further exploded details.
Figure 4:
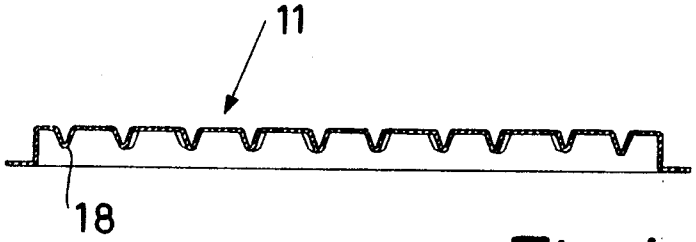
FIG. 4 shows an inverted cross section view of the cover half along plane of cut IV—IV of FIG. 1.
Figure 3:
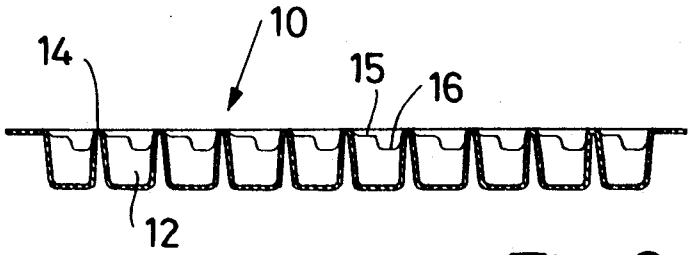
FIG. 3 shows a cross section view of the bottom half along plane of cut III—III of FIG. 1.

The base part 10 comprises a plurality of alveoli 12 with a generally circular plan to receive one primer each. As shown in FIG. 2, while the primer 13 has a cylindrical form with virtually flat bases, each alveolus preferably has slightly tapered walls and a concave bottom. Advantageously the alveoli are arranged in parallel rows separated from each other by beads 14 shaped with reliefs, formed as coupling rims. Each alveoli has an upper part 15, formed as a ledge rim, close to a bead for supporting the projecting upper rim 17 of the primer and an upper part 16 lowered near the opposite bead to identify a passage between the alveoli of each corresponding row.

Figure 5:
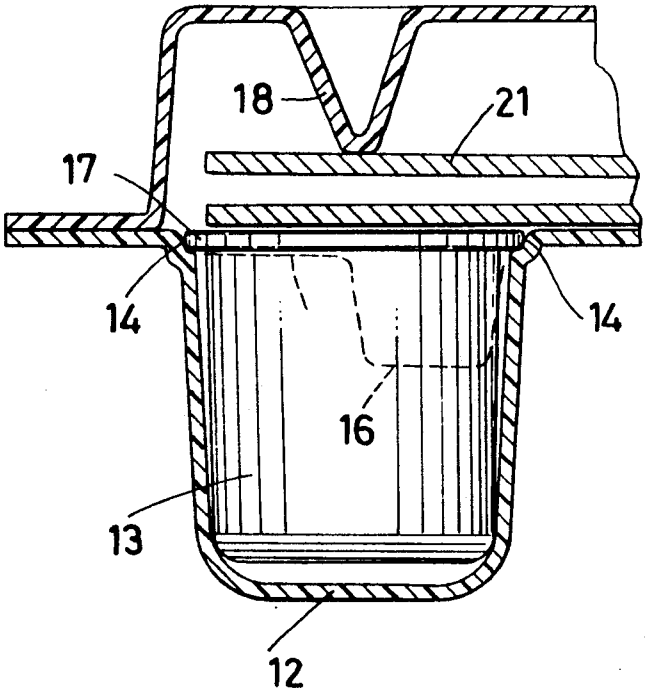
FIG. 5 shows an enlarged partial cross-section elevation of a container as in FIG. 1 in closed position.

The cover 11 comprises a plurality of ribs 18 arranged in parallel to correspond, upon closing of the container, with the center lines of the row of alveoli, as shown in FIG. 5. The bottom half includes pins 19 projecting for mating engagement with the complementary recesses provided in the cover half 11, so as to ensure secure closure of the container. The cover 11 also has a half-moon part 22 shaped in slight relief to ensure a grip, e.g. to assist in the finger nail, for opening the container. In accordance with the innovative principles of the invention, the container comprises also a card 21 folded in half to form a spacer with plan dimensions equal to the internal dimensions of the bottom half and the cover half; so as to be received between them. The card can also be designed to bear optionally inscriptions such as instructions, features of the primers, the trademark and so forth. In addition, if the manufacturing material of the container is transparent, the inscriptions on the card can be easily read even without opening the container so as to make superfluous external printing or glueing of other labels.

As shown in FIG. 5 each primer 13 is housed in an alveolus 12 with a slight pressure applied by the relief formed in the bead 14 which engages lightly with the rim 17 near the percussion surface of the primer 13. In addition, the slightly tapered side walls of the alveolus substantially adheres to the cylindrical wall of the respective primer. In addition to sealing the primer in place, this adhesion also insulates the inside of the alveolus in relation to the outside to prevent entry of humidity, which could make the powders of the primer partially or entirely inert.

The card 21 is pressed by the ribs 18 on the primers so as to further ensure against inadvertent movement from the alveoli. The concave bottom of each alveolus, as best seen in FIG. 5, provides a shock absorbing function against any shocks, in a manner similar to that of the spaces provided in the cover half between the ribs 18 and the card 21 which is arranged to protect the percussion part of the primer.

In addition, the concave bottoms of the alveoli and the spaces between the alveoli and the ribs allow venting of dangerous gases which develop in the instance of accidental explosion of a packaged primer, thereby reducing the shock wave and hence the probability of a chain explosion of other nearby primers. The beads 14 and the card 21 limit the propagation of the flame inside the container.

As is evident, the rise of a thin plastic sheet minimize the use of material and greatly simplifies production, e.g. with a single heat forming operation. It is therefore, possible, in accordance with the invention, to achieve the predetermined objects of obtaining a safe container for explosive primers at a low cost.

Although the invention has been described for a specific embodiment it is evident that many alternatives and variations, such as in materials and dimensions, will be apparent to those skilled in the art in light of the foregoing description. Accordingly, the invention is intended to embrace all of the alternatives and variations that fall within the spirit and scope of the invention. For example, if the action of holding the primers in the alveoli due to friction of the respective contact walls is considered sufficient, the coupling rims 14 and ledge rims 15 can be out of contact with the projecting rim 17 of the primers or absent, even partially. In addition, the closing of the base 10 with the cover 11 can be performed by other engagement means in place of the pins 19 and recesses 20.

I claim:

1. Container comprising a bottom half hingedly-connected to a cover half;

the bottom half having formed therein a plurality of alveoli arranged in parallel rows, each aveolus having a mouth, a side wall and a concave bottom, each aveolus being configured for housing an explosive primer for firearm cartridges with a percussion surface of the primer positioned near the mouth of the alveolus and a space defined between the concave bottom and an end of the primer opposite the percussion surface; and the cover half configured for hingedly closing upon the bottom half for substantially isolating the mouths of the alveoli from the outside of the container, the cover half including a rib directly over and aligned with the center line of each row of alveoli to constitute upon closing a limit to the movement of the primers from the mouths of the alveoli.

2. Container in accordance with claim 1, wherein the bottom half further includes between adjacent rows of alveoli, beads having reliefs formed near the mouth of each alveolus for engagement of a portion of the primer near the percussion surface in such a way as to hold the primer in the alveolus and constitute a separation between the rows of alveoli.

3. Container in accordance with claim 1, wherein the mouths of two contiguous alveoli of the same row are at least partially lowered to constitute a side passage between the contiguous alveoli.

4. Container in accordance with claim 1 further including a spacer element, the spacer element being configured for placement between the mouths of the alveoli and the cover half so as to be pressed by said ribs against the percussion surfaces of the primers housed in the alveoli.

5. Container in accordance with claim 4, wherein the spacer element comprises a sheet of cardboard designed to contain information on the characteristics of the primers in the container.

6. Container in accordance with claim 1 further having means for locking the cover half in a closed position with the cover half hingedly closed upon the bottom half.

7. Container in accordance with claim 6, wherein the locking means comprises projections forming pins on one of the halves and complementary seats in the other of the halves, the projections adapted to engage the complementary seats.

8. Container in accordance with claim 1, wherein the side wall of each alveolus is tapered to engage the primer housed therein and substantially seal the end of the primer opposite the percussion surface in such a way as to prevent infiltration of humidity from the outside.

9. Container in accordance with claim 1, wherein the bottom half and the cover half are hingedly formed together from a single sheet of material.

* * * * *